US005888379A

United States Patent [19]

Ushio et al.

[11] Patent Number: 5,888,379

[45] **Date of Patent: *Mar. 30, 1999**

[54] PROCESS FOR PRODUCING A FUEL OIL BASE MATERIAL

[75] Inventors: Masaru Ushio; Minoru Hatayama, both of Yokohama, Japan

[73] Assignee: Nippon Oil Co., Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 696,069

[22] Filed: Aug. 13, 1996

[30] Foreign Application Priority Data

Aug. 21, 1995 [JP] Japan ..... 7-233192

[51] Int. Cl.[6] ..... C10G 45/00

[52] U.S. Cl. ..... 208/210; 208/213

[58] Field of Search ..... 208/210, 213

[56] References Cited

U.S. PATENT DOCUMENTS

| | | | |
|---|---|---|---|
| 3,594,307 | 7/1971 | Kirk | 208/210 |
| 3,876,530 | 4/1975 | Frayer et al. | 208/210 |
| 5,110,444 | 5/1992 | Haun et al. | 208/210 |
| 5,176,820 | 1/1993 | Lew | 208/210 |
| 5,403,470 | 4/1995 | Kokayeff et al. | 208/212 |

FOREIGN PATENT DOCUMENTS 3086793 4/1991 Japan .

OTHER PUBLICATIONS

"Modern Petroleum Technology", Edited by G.D. Hobson, Published by Applied Science Publishers Ltd—1973, No Month. pp. 366 & 369.

*Primary Examiner*—Walter D. Griffin
*Assistant Examiner*—Nadine Preisch
*Attorney, Agent, or Firm*—Ostrolenk, Faber, Gerb & Soffen, LLP

[57] ABSTRACT

A process for producing a fuel oil base material having a lower sulfur content than that of stock oil and a dry sludge content of 0.05 mass % or less, which involves hydrotreating the stock oil having a dry sludge content of 0 to 5.0 mass % and a sulfur content of 1.0 to 10 mass % in two stages is provided, wherein the temperature of first-stage hydrotreatment is 340° to 450° C. and the temperature of second-stage hydrotreatment is 200° to 440° C. and maintained at a temperature lower than the temperature of the first-stage hydrotreatment.

9 Claims, No Drawings

PROCESS FOR PRODUCING A FUEL OIL BASE MATERIAL

BACKGROUND OF THE INVENTION

1. Field of the Invention

This invention relates to a process for producing a fuel oil base material and, more specifically, to a process for producing a fuel oil base material by hydrotreating a petroleum distillation residue having a relatively high sulfur content which is obtained from an atmospheric distillation unit or a vacuum distillation unit under specified conditions.

2. Background Art

Heretofore, in Japan, fuel oil has been produced by mixing as a main base material an atmospheric residue having a low sulfur content which is obtained by distilling crude oil having a low sulfur content in an atmospheric distillation unit to remove light hydrocarbons such as naphtha, kerosine or gas oil, or a vacuum residue having a low sulfur content which is obtained by further distilling this low-sulfur atmospheric residue in a vacuum distillation unit to remove vacuum gas oil with kerosine, gas oil or the like to control the viscosity thereof.

Meanwhile, from viewpoints of a short supply of low-sulfur crude oil, effective use of atmospheric or vacuum residues obtained from crude oil having a high sulfur content, and an increase in the production of a heart cut such as kerosine, gas oil or the like for the control of viscosity, hydrotreating processes for producing a fuel oil base material having a low sulfur content and low viscosity by contacting an atmospheric or vacuum residue obtained from crude oil having a high sulfur content with a hydrotreating catalyst at a high temperature and at a high hydrogen partial pressure to promote desulfurization, denitrification and cracking reactions have been developed and commercially operated.

Typical operation conditions for the hydrotreating processes include a reaction temperature of 350° to 450° C., a hydrogen partial pressure at an inlet of a reactor of 9.8 to 19.6 MPa, a liquid hourly space velocity of 0.1 to 5.0 $h^{-1}$ and a hydrogen/oil ratio at an inlet of a reactor of 250 to 1,700 $Nm^3/m^3$.

Although these hydrotreating processes, as described above, are extremely useful from viewpoints of a short supply of low-sulfur crude oil, effective use of atmospheric or vacuum residues obtained from crude oil having a high sulfur content, and an increase in the production of a heart cut such as kerosine, gas oil or the like for the control of viscosity, when a distillation residue is hydrotreated under high-severity operation conditions such as higher reaction temperature, dry sludge deposits in the product. The term "dry sludge" generally denotes particles essentially composed of asphaltene molecules having a diameter of 1.0 $\mu$m or more.

When a base material having a high content of dry sludge is used as the base material of fuel oil, there is the possibility that it will grow into huge sludge when it is mixed with another base material or during the period when it is stored, causing such troubles as a blocked fuel oil filter or centrifugal oil purifier, fouling of a fuel oil heater, a choked fuel oil jet nozzle of a combustion engine, and the like.

Therefore, a hydrotreating process has so far been inevitably restricted by operation conditions such as a reaction temperature whose upper limit is that dry sludge does not deposit.

The reaction temperature at the start of operation is determined, taking into consideration an increase in the reaction temperature for compensating for a reduction in the activity of a hydrotreating catalyst used in the hydrotreatment of a distillation residue during operation because the activities of desulfurization, denitrification and cracking reactions generally deteriorate with the passage of operation time. The activity of the catalyst sometimes deteriorates faster than expected due to a change in type of stock oil typified by crude oil during operation, a change in the target value of the sulfur content of hydrotreated oil, or the like, and accordingly, a reaction temperature designed for the end of operation may be reached in the middle of operation.

Therefore, even if the reaction temperature at the start of operation is set to a temperature lower than a temperature at which dry sludge does not deposit, when a reaction temperature designated for the end of operation is reached in the middle of operation, dry sludge is produced. Therefore, the process has been restricted thereafter such that the conversions of desulfurization, denitrification and cracking reactions or the hydrotreatment rate of a vacuum residue that requires severe reaction conditions are reduced, only an atmospheric residue whose reaction conditions are relatively mild is hydrotreated, or the amount of the residue hydrotreated is reduced.

SUMMARY OF THE INVENTION

It is therefore an object of the present invention to provide a process for producing a fuel oil base material having a low sulfur content and a low dry sludge content by hydrotreating stock oil having a relatively high sulfur content under severe conditions.

The inventors of the present invention have conducted studies to solve the above problems which occur when a fuel oil base material having a low sulfur content is obtained by hydrotreating an oil distillation residue having a relatively high sulfur content under severe conditions and have found that a fuel oil base material having a low sulfur content and a low dry sludge content can be obtained by hydrotreating stock oil under specified conditions. The present invention is predicated upon this finding.

The present invention provides a process for producing a fuel oil base material having a lower sulfur content than stock oil, which comprises hydrotreating the stock oil having a dry sludge content of 0 to 5.0 mass % and a sulfur content of 1.0 to 10 mass % in two stages, wherein the temperature of first-stage hydrotreatment is 340° to 450° C. and the temperature of second-stage hydrotreatment is 200° to 440° C. and maintained at a temperature lower than the temperature of the first-stage hydrotreatment.

DETAILED DESCRIPTION OF THE PREFERRED EMBODIMENTS

The present invention is described in detail hereinunder.

The stock oil used in the process for producing a fuel oil base material according to the present invention is exemplified by oil distillation residues.

The oil distillation residues include, for example, residues obtained from an atmospheric distillation unit, containing a fraction having a distillation temperature of 300° C. or more (hereinafter so-called as "~° C. or more fraction") in an amount of 70 mass % or more, preferably 90 mass % or more, more preferably 95 mass % or more; residues obtained from a vacuum distillation unit, containing a 400° C. or more fraction in an amount of 70 mass % or more, preferably 90 mass % or more, more preferably 95 mass % or more; mixtures of these atmospheric residues and vacuum residues in desired ratios; hydrotreated oil having a reduced sulfur or nitrogen content obtained by hydrotreating the above atmospheric residues, vacuum residues and mixtures thereof; and mixtures thereof.

The term "distillation temperature" as used herein means a temperature measured in accordance with "Item 6. Vacuum Distillation Test Method" of "Petroleum Products-Distillation Test Method" specified in JIS K 2254. The distillation temperature of an oil fraction in the present invention refers to a value measured in accordance with the above method.

As the stock oil of the present invention, mixture oil comprising 40 parts or less by weight, preferably 20 parts or less by weight of cracked heavy gas oil (heavy cycle oil) or slurry oil obtained from a catalytic cracking unit (FCC) based on 100 parts by weight of an oil distillation residue is preferably used.

Further, as the stock oil of the present invention, mixture oil comprising 50 parts or less by weight, preferably 30 parts or less by weight of recycled oil which is obtained by recycling part of oil at the exit of second-stage hydrotreatment to be described later based on 100 parts by weight of the above oil distillation residue or mixture oil is also preferably used.

The lower limit of dry sludge content of stock oil in the present invention is 0 mass % whereas the upper limit thereof is 5.0 mass %, preferably 1.0 mass %. When the upper limit of dry sludge content is more than 5.0 mass %, there may arise such problems as a blocked strainer or valve of a stock oil feed system in the hydrotreatment step, deterioration in heat transfer efficiency caused by fouling of a heat exchanger or heating furnace, and the like.

The term "dry sludge content" as used in the present invention denotes the total amount of sediment measured in accordance with "Standard Test Method for Determination of Total Sediment in Residual Fuels" specified in ASTM D 4870-92. Hereinafter, the dry sludge content in the present invention refers to a value measured in accordance with this method.

The lower limit of sulfur content of this oil distillation residue is 1.0 mass %, preferably 2.0 mass % whereas the upper limit thereof is 10 mass %, preferably 6.0 mass %. When the sulfur content is less than 1.0 mass %, it is possible to produce a fuel oil base material without carrying out two-stage hydrotreatment as in the present invention and it is disadvantageous in terms of energy cost. When the sulfur content is more than 10 mass %, the sulfur content of the resulting fuel oil base material is high and the amount of a sulfur oxide contained in the combustion exhaust gas is increased when it is used as a boiler fuel. To further reduce the sulfur content of the resulting fuel oil base material, the construction costs of a reactor or a peripheral device sharply rise or a large amount of a cutter material is required disadvantageously.

The term "sulfur content" as used in the present invention means a sulfur content measured in accordance with "Item 6. Radiation Exciting Method" of "Crude Oil and Petroleum Products—Sulfur Content Test Method" specified in JIS K 2541-1992. Hereinafter, the sulfur content in the present invention refers to a value measured in accordance with the above method.

In the present invention, first-stage hydrotreatment is carried out on the stock oil.

The lower limit of first-stage hydrotreatment temperature is 340° C., preferably 370° C. whereas the upper limit thereof is 450° C., preferably 430° C. When the first-stage hydrotreatment temperature is less than 340° C., desulfurization, denitrification and cracking reactions do not proceed to practical ranges because catalytic activity is not fully developed. On the other hand, when the hydrotreatment temperature is more than 450° C., a coking reaction becomes violent, coke accumulates on the catalyst, catalytic activity sharply deteriorates, and catalyst life shortens disadvantageously.

Conditions other than temperature in the first-stage hydrotreatment are arbitrary.

However, the lower limit of hydrogen partial pressure at the inlet of the first stage is generally 8.0 MPa, preferably 9.8 MPa whereas the upper limit thereof is 25.0 MPa, preferably 19.6 MPa. When the hydrogen partial pressure at the inlet is less than 8.0 MPa, there is the possibility that coke will be produced on the catalyst violently and catalyst life will become extremely short. On the other hand, when the hydrogen partial pressure is more than 25.0 MPa, there is the possibility that the construction costs of a reactor, peripheral device or the like will rise sharply and economic utility will be lost.

The lower limit of liquid hourly space velocity (LHSV) of the stock oil in the first stage is generally 0.05 $h^{-1}$, preferably 0.1 $h^{-1}$ whereas the upper limit thereof is 5.0 $h^{-1}$, preferably 2.0 $h^{-1}$. When the liquid hourly space velocity (LHSV) is less than 0.05 $h^{-1}$, there is the possibility that the construction costs of a reactor will become huge and economic utility will be lost. On the other hand, when the liquid hourly space velocity (LHSV) is more than 5.0 $h^{-1}$, there is the possibility that the catalytic activity will not be fully developed and desulfurization, denitrification and cracking reactions will not proceed to practical ranges.

The lower limit of hydrogen/oil ratio at the inlet of the first stage is generally 250 $Nm^3/m^3$, preferably 600 $Nm^3/m^3$ whereas the upper limit thereof is 1,700 $Nm^3/m^3$, preferably 1,500 $Nm^3/m^3$. When the hydrogen/oil ratio is less than 250 $Nm^3/m^3$, it is likely that coke on the catalyst will be produced violently and catalyst life will become extremely short. On the other hand, when the hydrogen/oil ratio is more than 1,700 $Nm^3/m^3$, it is likely that the construction costs of the reactor, a peripheral device or the like will rise sharply and economic utility will be lost.

The operation of the first-stage hydrotreatment step can be carried out in cocurrent upflows or downflows of oil and gas or countercurrent flows of oil and gas. A single reactor or a plurality of continuous reactors filled with a catalyst may be used in the first-stage hydrotreatment step. Further, the reactor may have a single catalyst bed or a plurality of catalyst beds therein.

Moreover, a liquid, gas or mixture of a gas and a liquid may be injected between the reactors or between the catalyst beds in the first-stage hydrotreatment step for the purpose of controlling the reaction temperature at the inlet of the subsequent reactor or catalyst bed.

Preferred examples of the gas as used herein include hydrogen; hydrocarbons which can be existent as a gas at injection temperature and pressure such as paraffin-based hydrocarbons having 1 to 6 carbon atoms exemplified by methane, ethane, propane, butane, pentane and hexane, and mixtures thereof; and mixtures of hydrogen and these hydrocarbons. They may include other substances which can be existent as a gas at injection temperature and pressure, such as hydrogen sulfide, ammonia and nitrogen.

Preferred examples of the liquid as used herein include hydrocarbons which can be existent as a liquid at injection temperature and pressure such as petroleum distillates exemplified by kerosine, straight-run gas oil and vacuum gas oil; petroleum distillation residues; hydrotreated oil of petroleum distillates and petroleum distillation residues; thermally cracked oil of petroleum distillates and petroleum distillation residues; catalytic cracked oil of petroleum distillates and petroleum distillation residues; mixtures thereof; and the like. More preferably, recycled part of oil at the outlet of the second-stage hydrotreatment step to be described hereinafter is used.

When a gas or liquid is injected between reactors or between catalyst beds in the first stage, the amount of injection is arbitrary. However, when a gas is injected, the amount of injection should be 1,700 $Nm^3/m^3$ or less in terms of gas/oil ratio. When a liquid is injected, the amount of injection should be 1 $Nm^3/m^3$ or less in terms of liquid/oil ratio.

When a plurality of reactors or catalyst beds are used in the first-stage hydrotreatment step, the temperature of the first-stage hydrotreatment in the present invention is defined as catalyst weight average temperature (WABT) obtained by multiplying an average of inlet and outlet temperatures of each of the catalyst beds of the first stage with a catalyst loading weight ratio of each of the catalyst beds and summing up all the products, regardless of the injection of a gas, liquid or mixture of a liquid and a gas between the reactors or between the catalyst beds and the number of reactors.

Any conventionally known hydrotreating catalysts can be used as the hydrotreating catalyst used in the first-stage hydrotreatment step. Preferred examples of the catalyst include catalysts containing metals having hydrotreating activity carried on porous inorganic oxides exemplified by alumina, silica, titania, zirconia, magnesia, alumina silica, alumina-boron oxide, alumina-titania, alumina-zirconia, alumina-magnesia, alumina-silica-zirconia, alumina-silica-titania, zeolites, and clay minerals such as sepiolite, montmorillonite and the like as carriers.

As the metal carried on the above carriers, at least one metal having hydrotreating activity selected from the group consisting of metals of groups VIA, VA, VB and VIII of the Periodic Table is preferably used. Particularly preferred is a catalyst containing cobalt, molybdenum or nickel or a combination of two or three out of cobalt, molybdenum and nickel carried on a porous inorganic oxide. As the hydrotreating catalyst used in the first-stage hydrotreatment step of the present invention, even commercial hydrotreating catalysts can attain the object of the present invention satisfactorily and the present invention is in no way limited to a particular kind of catalyst.

The dry sludge content of the hydrotreated oil obtained in the first-stage hydrotreatment step described above is generally higher than the dry sludge content of the stock oil or at least 0.05 mass %, more generally 0.2 mass % or more.

By the first-stage hydrotreatment step, most of the desulfurization, denitrification and cracking reactions of the stock oil are substantially accomplished.

Although the sulfur content of the hydrotreated oil obtained in the first-stage hydrotreatment step is in no way limited, the lower limit thereof is generally 0.01 mass %, preferably 0.1 mass % whereas the upper limit thereof is 2.0 mass %, preferably 1.0 mass %.

Although the nitrogen content of the hydrotreated oil obtained in the first-stage hydrotreatment step is in no way limited, the lower limit thereof is 0.01 mass %, preferably 0.1 mass % whereas the upper limit thereof is 1.0 mass %, preferably 0.5 mass %.

The term "nitrogen content" as used in the present invention denotes a nitrogen content measured in accordance with "Item 7. Chemiluminescence Method" of "Crude Oil and Petroleum Products—Nitrogen Content Test Method" specified in JIS K 2609-1990. Hereinafter, the nitrogen content in the present invention refers to a value measured in accordance with the above method.

The hydrotreated oil which has been subjected to the first-stage hydrotreatment as described-above is further subjected to second-stage hydrotreatment.

The lower limit of the temperature of the second-stage hydrotreatment is 200° C., preferably 250° C. whereas the upper limit thereof is 440° C., preferably 400° C. When the temperature of the second-stage hydrotreatment is less than 200° C., the hydrotreatment reaction of a sludge component does not proceed to a practical range because the catalytic activity is not fully developed. When the temperature is more than 440° C., the hydrotreatment of a sludge component does not proceed and conversely the sludge component is produced disadvantageously.

Further, in the present invention, it is important to carry out hydrotreatment by setting the temperature to a value lower than the temperature of the first-stage hydrotreatment in the second-stage hydrotreatment step. If the hydrotreatment temperature in the second-stage hydrotreatment step is lower than the temperature of the first-stage hydrotreatment, it can be set to any temperature within the above range. However, the difference of the hydrotreatment temperature between the two stages is preferably 10° C. or more, more preferably 20° C. or more.

In the present invention, when the temperature of the second-stage hydrotreatment is the same or higher than the temperature of the first-stage hydrotreatment, the hydrotreatment of a sludge component does not proceed and conversely the sludge component is produced disadvantageously.

Conditions other than temperature in the second-stage hydrotreatment step are arbitrary.

However, the lower limit of hydrogen partial pressure at the inlet of the second stage is generally 1.0 MPa whereas the upper limit thereof is 25.0 MPa, preferably 19.6 MPa. When the hydrogen partial pressure at the inlet is less than 1.0 MPa, there is the possibility that the catalytic activity will not be fully developed and the hydrotreatment reaction of the sludge component will not proceed to a practical range. On the other hand, when the hydrogen partial pressure is more than 25.0 MPa, the construction costs of the reactor, peripheral device or the like will rise sharply and economic utility will be lost.

The lower limit of liquid hourly space velocity (LHSV) of the stock oil in the second stage (i.e. hydrotreated oil which has been subjected to the first-stage hydrotreatment) is generally 0.1 $h^{-1}$, preferably 0.2 $h^{-1}$ whereas the upper limit thereof is 10 $h^{-1}$, preferably 4.0 $h^{-1}$. When the liquid hourly space velocity (LHSV) is less than 0.1 $h^{-1}$, there is the possibility that the construction costs of the reactor will become huge and economic utility will be lost. On the other hand, when the liquid hourly space velocity (LHSV) is more than 10 $h^{-1}$, there is the possibility that the catalytic activity will not be fully developed and the hydrotreatment reaction of the sludge component will not proceed to a practical range.

The lower limit of hydrogen/oil ratio at the inlet of the second stage is generally 50 $Nm^3/m^3$, preferably 200 $Nm^3/m^3$ whereas the upper limit thereof is 1,700 $Nm^3/m^3$, preferably 1,500 $Nm^3/m^3$. When the hydrogen/oil ratio is less than 50 $Nm^3/m^3$, it is likely that coke will be produced on the catalyst violently and catalyst life will become extremely short. On the other hand, when the hydrogen/oil ratio is more than 1,700 Nm $^3/m^3$, it is likely that the construction costs of the reactor, peripheral device or the like will increase sharply and economic utility will be lost.

The operation of the second-stage hydrotreatment step can be carried out in cocurrent upflows or downflows of oil and gas or countercurrent flows of oil and gas. A single reactor or a plurality of continuous reactors filled with a catalyst may be used in the second-stage hydrotreatment step. Further, the reactor may have a single catalyst bed or a plurality of catalyst beds therein.

Moreover, a liquid, gas or mixture of a gas and a liquid may be injected between the reactors or between the catalyst beds in the second-stage hydrotreatment step for the purpose of controlling the reaction temperature at the inlet of the subsequent reactor or catalyst bed.

Preferred examples of the gas as used herein include hydrogen; hydrocarbons which can be existent as a gas at injection temperature and pressure such as paraffin-based hydrocarbons having 1 to 6 carbon atoms, exemplified by methane, ethane, propane, butane, pentane and hexane, and mixtures thereof; and mixtures of hydrogen and these hydrocarbons. They may include other substances which can be existent as a gas at injection temperature and pressure, such as hydrogen sulfide, ammonia and nitrogen.

Preferred examples of the liquid as used herein include hydrocarbons which can be existent as a liquid at injection temperature and pressure such as petroleum distillates exemplified by kerosine, straight-run gas oil and vacuum gas oil; petroleum distillation residues; hydrotreated oil of petroleum distillates and petroleum distillation residues; thermally cracked oil of petroleum distillates and petroleum distillation residues; catalytic cracked oil of petroleum distillates and petroleum distillation residues; mixtures thereof; and the like. More preferably, recycled part of oil at the outlet of the second-stage hydrotreatment step to be described hereinafter is used.

When a gas or liquid is injected between reactors or between catalyst beds in the second stage, the amount of injection is arbitrary. However, when a gas is injected, the amount of injection should be 1,700 $Nm^3/m^3$ or less in terms of gas/oil ratio. When a liquid is injected, the amount of injection should be 1 $Nm^3/m^3$ or less in terms of liquid/oil ratio.

When a plurality of reactors or catalyst beds are used in the second-stage hydrotreatment step, the temperature of the second-stage hydrotreatment in the present invention is defined as catalyst weight average temperature (WABT) obtained by multiplying an average of inlet and outlet temperatures of each of the catalyst beds of the second stage with a catalyst loading weight ratio of each of the catalyst beds and summing up all the products, regardless of the injection of a gas, liquid or mixture of a liquid and a gas between the reactors or between the catalyst beds and the number of reactors.

Any conventionally known hydrotreating catalysts can be used as the hydrotreating catalyst used in the second-stage hydrotreatment step. Preferred examples of the catalyst include catalysts containing metals having hydrotreating activity carried on porous inorganic oxides exemplified by alumina, silica, titania, zirconia, magnesia, alumina-silica, alumina-boron oxide, alumina-titania, alumina-zirconia, alumina-magnesia, alumina-silica-zirconia, alumina-silica-titania, zeolites, and clay minerals such as sepiolite, montmorillonite and the like as carriers.

As the metal carried on the above carriers, at least one metal having hydrotreating activity selected from the group consisting of metals of groups VIA, VA, VB and VIII of the Periodic Table is preferably used. Particularly preferred is a catalyst containing cobalt, molybdenum or nickel or a combination of two or three out of cobalt, molybdenum and nickel carried on a porous inorganic oxide. As the hydrotreating catalyst used in the second-stage hydrotreatment step of the present invention, even commercial hydrotreating catalysts can attain the object of the present invention satisfactorily and the present invention is in no way limited to a particular kind of catalyst.

In the present invention, the first-stage hydrotreatment and the second-stage hydrotreatment may be carried out in a single reactor or separate two or more reactors. The inside of the reactor may be divided into a plurality of catalyst beds.

In the present invention, the method for reducing the temperature of the second-stage hydrotreatment to a level lower than the temperature of the first-stage hydrotreatment is not particularly limited, but any method can be employed. Any conventionally known method may be used, such as one for injecting a low-temperature gas or liquid, or both of a low-temperature gas and liquid, one for heat exchanging with a low-temperature fluid by a heat exchanger, and the like.

Preferred examples of the gas as used herein include hydrogen; hydrocarbons which can be existent as a gas at injection temperature and pressure such as paraffin-based hydrocarbons having 1 to 6 carbon atoms, exemplified by methane, ethane, propane, butane, pentane and hexane, and mixtures thereof; and mixtures of hydrogen and these hydrocarbons. They may include other substances which can be existent as a gas at injection temperature and pressure, such as hydrogen sulfide, ammonia and nitrogen.

Preferred examples of the liquid as used herein include hydrocarbons which can be existent as a liquid at injection temperature and pressure such as petroleum distillates exemplified by kerosine, straight-run gas oil and vacuum gas oil; petroleum distillation residues; hydrotreated oil of petroleum distillates and petroleum distillation residues; thermally cracked oil of petroleum distillates and petroleum distillation residues; catalytic cracked oil of petroleum distillates and petroleum distillation residues; mixtures thereof; and the like. More preferably, recycled part of oil at the outlet of the second-stage hydrotreatment step is used.

The first-stage hydrotreatment and the second-stage hydrotreatment in the present invention are not always operated continuously, but may be carried out separately. When the both stages are carried out separately, conditions between the first stage and the second stage are not particularly limited.

In the present invention, a fuel oil base material having a lower sulfur content than stock oil can be finally obtained by the above two-stage hydrotreatment. The sulfur content of the thus obtained fuel oil base material may be any value if it is lower than that of the stock oil. However, the accomplishment rate of the desulfurization reaction is preferably 80% or more, more preferably 90% or more based on the stock oil. The dry sludge content of the finally obtained fuel oil base material is generally 0.1 mass % or less, preferably 0.05 mass % or less, more preferably 0.04 mass % or less.

The term "accomplishment rate of the desulfurization reaction" as used in the present invention denotes a value shown by the following equation (1). Hereinafter, the accomplishment rate of the desulfurization reaction in the present invention refers to a value calculated from this equation (1).

$$SR=((S0)-(S2))/(S0)*100 \quad \text{Equation (1)}$$

(wherein , SR is the accomplishment rate of desulfurization reaction (%), S0 is sulfur content of introduced oil (mass %), and S2 is sulfur content of processed oil (mass %))

The nitrogen content of the obtained fuel oil base material is in no way limited, but the accomplishment rate of the denitrification reaction is generally 10% or more, preferably 30% or more based on the stock oil.

The term "accomplishment rate of the denitrification reaction" as used in the present invention denotes a value shown by the following equation (2). Hereinafter, the accomplishment rate of the denitrification reaction in the present invention refers to a value calculated from this equation (2).

$$NR=((N0)-(N2))/(N0)*100 \quad \text{Equation (2)}$$

(wherein, NR the an accomplishment rate of denitrification reaction (%), N0 is nitrogen content of introduced oil (mass %), and N2 is nitrogen content of processed oil (mass %))

The total accomplishment rate of the cracking reaction by two-stage hydrotreatment in the present invention is arbitrary, but it is generally 20% or more, preferably 40% or more.

The term "accomplishment rate of the cracking reaction" as used in the present invention denotes a value shown by the following equation (3). Hereinafter, the accomplishment rate of the cracking reaction in the present invention refers to a value calculated from this equation (3).

$$CR=((F0)-(F2))/(F0)*100 \quad \text{Equation (3)}$$

(wherein, CR is the accomplishment rate of cracking reaction (%), F0 is 565° C. or more fraction of introduced oil (mass %), and F2 is 565° C. or more fraction of processed oil (mass %))

In the present invention, it is desirable that the accomplishment rate of the desulfurization reaction in the first-stage hydrotreatment be 80% or more, preferably 90% or more, more preferably 95% or more, of the accomplishment rate of the desulfurization reaction in the total hydrotreatment including the-second stage hydrotreatment.

In the present invention, it is desirable that the accomplishment rate of the denitrification reaction in the first-stage hydrotreatment be 50% or more, preferably 80% or more, more preferably 90% or more of the accomplishment rate of the denitrification reaction in the total hydrotreatment including the second-stage hydrotreatment.

Further, in the present invention, it is desirable that the accomplishment rate of the cracking reaction in the first-stage hydrotreatment be 75% or more, preferably 85% or more, more preferably 90% or more of the accomplishment rate of the cracking reaction in the total hydrotreatment including the second-stage hydrotreatment.

The fuel oil base material obtained by the present invention can be used alone as a fuel oil product. A fuel oil product may be prepared by mixing the fuel oil base material of the present invention with other fuel oil base materials such as oil distillation residues; kerosine, straight-run gas oil; vacuum gas oil; gas oil and residual oil obtained by thermally cracking petroleum distillation residues and hydrotreated oil thereof; light gas oil (light cycle oil), heavy gas oil (heavy cycle oil) and slurry oil obtained from a catalytic cracking unit; and the like.

EXAMPLES

The following examples and comparative examples are provided for the purpose of further illustrating the present invention but are in no way to be taken as limiting.

Example 1

A commercial desulfurization catalyst containing 3 mass % of NiO and 11 mass % of $MoO_3$ carried on an alumina carrier was charged into a stainless steel reactor for the first-stage hydrotreatment and a stainless steel reactor for the second-stage hydrotreatment which were connected in series and was pre-sulfurized. The vacuum distillation residual oil having properties shown in Table 1 was used as stock oil and continuously hydrotreated under reaction conditions shown in Table 2 using these reactors.

The properties of the hydrotreated oil obtained from the outlets of the first-stage reactor and the second-stage reactor and the accomplishment rate of the desulfurization reaction, the accomplishment rate of the denitrification reaction, and the accomplishment rate of the cracking reaction in the total hydrotreatment, as well as the ratios of the accomplishment rate of the desulfurization reaction, the accomplishment rate of the denitrification reaction and the accomplishment rate of the cracking reaction in the first stage to the respective accomplishment rates in the total hydrotreatment are shown in Table 2.

Example 2

The same stock oil and desulfurization catalyst as used in Example 1 were used and hydrotreatment was carried out under the same reaction conditions as in Example 1 except that the temperature of the first-stage reactor was changed to 450° C. as shown in Table 2. The results are shown in Table 2.

Example 3

The same stock oil and desulfurization catalyst as used in Example 1 were used and hydrotreatment was carried out under the same reaction conditions as in Example 1 except that the temperature of the second-stage reactor was changed to 380° C. as shown in Table 2. The results are shown in Table 2.

Example 4

To confirm the effect of the liquid hourly space velocity (LHSV) of the second stage, the same stock oil and desulfurization catalyst as used in Example 1 were used and hydrotreatment was carried out under the same reaction conditions as in Example 1 except that the amount of the catalyst charged into the second-stage reactor was reduced from that of Example 1 by 20% by volume and the reaction conditions of the second-stage reactor were changed to an LHSV of 2.5 $h^{-1}$ and a temperature of 380° C. as shown in Table 2. The results are shown in Table 2.

Example 5

The same stock oil and desulfurization catalyst as used in Example 1 were used and hydrotreatment was carried out under the same reaction conditions as in Example 1 except that the hydrogen partial pressure at the inlet of the first-stage reactor was changed to 16.7 MPa. The results are shown in Table 2.

Comparative Example 1

To clarify the effect of the low-temperature hydrotreatment in the second-stage reactor, the same stock oil and desulfurization catalyst as used in Example 1 were used and hydrotreatment was carried out using only the first-stage reactor and not through the second stage (reaction conditions were the same as in the first stage of Example 1). The results are shown in Table 2.

Comparative Example 2

To clarify the effect of the low-temperature hydrotreatment in the second-stage reactor, the same stock oil and desulfurization catalyst as used in Example 1 were used and hydrotreatment was carried out under the same conditions as in Example 1 except that the temperature of the second-stage reactor was set to 430° C., the same temperature as the first-stage reactor. The results are shown in Table 2.

Comparative Example 3

To clarify the effect of the low-temperature hydrotreatment in the second-stage reactor, the same stock oil and desulfurization catalyst as used in Example 1 were used and hydrotreatment was carried out under the same reaction conditions as in Example 1 except that the temperatures of the first-stage reactor and the second-stage reactor were set to 412° C. to ensure that the finally obtained hydrotreated oil had the same sulfur content as that of oil obtained in Example 1. The results are shown in Table 2.

Comparative Example 4

To clarify the need for setting the reaction temperature of the second stage to 200° C. or more in order to obtain a dry sludge content of 0.05 mass % or less for the final hydrotreated oil obtained from two-stage hydrotreatment, the same stock oil and desulfurization catalyst as used in Example 1 were used and hydrotreatment was carried out under the same reaction conditions as in Example 1 except that the temperature of the second-stage reactor was set to 190° C. The results are shown in Table 2.

TABLE 1

| Properties Of Vacuum Distillation Residual Oil | |
|---|---|
| Density @15° C. (g/cm$^3$) | 1.020 |
| Sulfur Content (S0) (mass %) | 3.7 |
| Nitrogen Content (N0) (mass %) (mass %) | 0.28 |
| Vanadium (ppm by mass) | 67 |
| Nickel (ppm by mass) | 36 |
| 565° C. (+) fraction (F0) (mass %) | 92 |
| Dry Sludge Content (mass %) | 0.01 or less |

Remarks: The term "565° C. (+) fraction" means the fraction having a distillation temperature of 565° C. or more.

TABLE 2

| | | | Example | | | | | Comparative Example | | | |
|---|---|---|---|---|---|---|---|---|---|---|---|
| | | | 1 | 2 | 3 | 4 | 5 | 1 | 2 | 3 | 4 |
| Reaction Conditions | Common In First And Second Stages | | | | | | | | | | |
| | Hydrogen Partial Pressure At Inlet (MPa) | | 10.8 | 10.8 | 10.8 | 10.8 | 16.7 | 10.8 | 10.8 | 10.8 | 10.8 |
| | Hydrogen/Oil Ratio At Inlet (Nm$^3$/m$^3$) | | 1100 | 1100 | 1100 | 1100 | 1100 | 1100 | 1100 | 1100 | 1100 |
| | First Stage | | | | | | | | | | |
| | LHSV (h$^{-1}$) | | 0.5 | 0.5 | 0.5 | 0.5 | 0.5 | 0.5 | 0.5 | 0.5 | 0.5 |
| | Reaction Temperature (°C.) | | 430 | 450 | 430 | 430 | 430 | 430 | 430 | 412 | 430 |
| | Second Stage | | | | | | | | | | |
| | LHSV (h$^{-1}$) | | 0.5 | 0.5 | 0.5 | 2.5 | 0.5 | — | 0.5 | 0.5 | 0.5 |
| | Reaction Temperature (°C.) | | 340 | 340 | 380 | 380 | 340 | — | 430 | 412 | 190 |
| Properties Of Processed Oil | First Stage | Dry Sludge Content (mass %) | 0.56 | 0.70 | 0.56 | 0.56 | 0.60 | 0.56 | 0.56 | 0.40 | 0.56 |
| | | Sulfur Content (mass %) | 0.36 | 0.19 | 0.36 | 0.36 | 0.24 | 0.36 | 0.36 | 0.64 | 0.36 |
| | | Nitrogen Content (mass %) | 0.19 | 0.14 | 0.19 | 0.19 | 0.15 | 0.19 | 0.19 | 0.22 | 0.19 |
| | | 565° C. (+) Fraction (mass %) | 51.6 | 34.0 | 51.9 | 51.9 | 51.8 | 51.9 | 51.9 | 67.5 | 51.9 |
| | Second Stage | Dry Sludge Content (mass %) | 0.00 | 0.04 | 0.01 | 0.02 | 0.00 | — | 0.63 | 0.23 | 0.49 |
| | | Sulfur Content (mass %) | 0.35 | 0.17 | 0.32 | 0.35 | 0.24 | — | 0.19 | 0.35 | 0.36 |
| | | Nitrogen Content (mass %) | 0.19 | 0.14 | 0.18 | 0.19 | 0.15 | — | 0.13 | 0.18 | 0.19 |
| | | 565° C. (+) Fraction (mass %) | 51.6 | 33.9 | 49.5 | 51.4 | 51.3 | — | 36.2 | 53.3 | 51.9 |
| Accomplishment Rate In Total Hydrotreatment | | | | | | | | | | | |
| Desulfurization Reaction (SR) (%) | | | 90.5 | 95.4 | 91.4 | 90.5 | 93.5 | 90.3 | 94.9 | 90.5 | 90.3 |
| Denitrification Reaction (NR) (%) | | | 32.1 | 50.0 | 35.7 | 32.1 | 46.4 | 32.1 | 53.6 | 35.7 | 32.1 |
| Cracking Reaction (CR) (%) | | | 43.9 | 63.2 | 46.2 | 44.1 | 44.2 | 43.6 | 60.7 | 42.1 | 43.6 |
| Ratio Of Accomplishment Rate In The First Stage To The Respective Accomplishment Rate In The Total Hydrotreatment | | | | | | | | | | | |
| Desulfurization Reaction (%) | | | 99.7 | 99.4 | 98.8 | 99.7 | 100 | — | 95.1 | 91.3 | 100 |
| Denitrification Reaction (%) | | | 100 | 100 | 90.0 | 100 | 100 | — | 60.0 | 60.0 | 100 |
| Cracking Reaction (%) | | | 99.3 | 99.8 | 94.4 | 98.8 | 98.8 | — | 71.9 | 63.3 | 100 |

As is obvious from the results of Table 2, according to the process of the present invention, even when an oil distillation residue having a relatively high sulfur content is used as stock oil, the sulfur content is made lower than that of the stock oil under severe hydrotreatment conditions and a fuel oil base material having a dry sludge content of 0.05 mass % or less can be obtained. Further, it is found that the resulting fuel oil base material has a lower nitrogen content than that of the stock oil and a much lower content of a 565° C. or more fraction.

In contrast to this, fuel oil base materials of Comparative Example 1 which was not subjected to the second-stage hydrotreatment, Comparative Example 3 in which the temperatures of the first-stage reactor and the second-stage reactor were set to 412° C. to ensure that the finally obtained hydrotreated oil had the same sulfur content as oil obtained in Example 1, and Comparative Example 4 in which the temperature of the second-stage reactor was set to 190° C. had dry sludge contents of 0.56 mass %, 0.23 mass % and 0.49 mass %, respectively, much higher than those of examples, though sulfur and nitrogen contents thereof were reduced to almost the same level as those of Example 1 and the 565° C. or more fraction thereof was reduced. Therefore, they are not suitable as fuel oil base materials.

A fuel oil base material of Comparative Example 2 in which the temperature of the second-stage reactor was set to 430° C., the same as that of the first-stage reactor had a dry sludge content of 0.63 mass %, much worse than other comparative examples, though sulfur and nitrogen contents thereof were lower than those of Example 1 and the 565° C. or tore fraction thereof was reduced.

According to the process of the present invention, even when an oil distillation residue having a relatively high sulfur content is used as stock oil, a fuel oil base material having a final dry sludge content of 0.05 mass % or less can be obtained by carrying out two-stage hydrotreatment under specific conditions.

Therefore, restrictions on operation conditions for normal hydrotreatment, such as the upper limit of reaction temperature at which dry sludge does not deposit and the lower limit of reaction pressure, can be greatly alleviated and the economical efficiency of the construction of a unit can be significantly improved.

What is claimed is:

1. A process for producing a fuel oil base material having a lower sulfur content than that of stock oil, said stock oil being oil distillation residues having a dry sludge content of 0 to 5.0 mass % and a sulfur content of 1.0 to 10 mass %, which comprises hydrotreating the stock oil in two stages, wherein the first-stage hydrotreatment temperature is 340° to 450° and the hydrogen partial pressure is 8–25 MPa, and the first stage product has a dry sludge content which is at least 0.05 mass % and is higher than that of the stock oil and the second-stage hydrotreatment temperature is 200° to 400° C. and the hydrogen partial pressure is 1–25 MPa and the second stage product has a lower dry sludge content of 0.05 mass % or less and wherein the second-stage temperature is lower than the temperature of the first-stage hydrotreatment by 10° C. or more.

2. A process for producing a fuel oil base material according to claim 1, wherein the hydrotreatment is accomplished in the presence of at least one hydrotreating catalyst containing metals having hydrotreating activity carried on porous inorganic oxides.

3. A process for producing a fuel oil base material according to claim 1, wherein the first-stage hydrotreatment temperature is 370° to 430° C. and the hydrogen partial pressure is 9.8 to 19.6 MPa, the second-stage hydrotreatment temperature is 250° to 400° C. and the hydrogen partial pressure is 1 to 19.6 MPa, and wherein the second-stage hydrotreatment temperature is at least 20° C. lower than the temperature of the first stage hydrotreatment, and wherein the first stage product dry sludge content is at least 0.2 mass %, and the second stage product dry sludge content is 0.04 mass % or less.

4. A process for producing a fuel oil base material according to claim 3, wherein the hydrotreatment is accomplished in the presence of at least one hydrotreating catalyst containing metals containing hydrotreating activity carried on porous inorganic oxides.

5. A process for producing a fuel oil base material according to claim 4, wherein the metal in the catalyst is one or two members selected from the group consisting of cobalt, molybdenum and nickel.

6. A process for producing a fuel oil base material according to claim 5, wherein said stock oil contains 40 parts per hundred or less of cracked heavy gas oil or slurry oil and 50 parts per hundred or less of recycled oil.

7. A process for producing a fuel oil base material according to claim 6, wherein said stock oil contains 20 parts per hundred or less of cracked heavy gas oil or slurry oil and 30 parts per hundred or less of recycled oil.

8. A process for producing a fuel oil base material according to claim 7, wherein the first-stage hydrotreatment is carried out at a liquid hourly space velocity of 0.05–5 $h^{-1}$and a hydrogen/oil ratio of 250–1700 $Nm^3/m^3$, and said second-stage hydrotreatment is effected at a liquid hourly space velocity of 0.1 to 10 $h^{-1}$ and a hydrogen/oil ratio of 50–1700 $Nm^3/m^3$.

9. A process for producing a fuel oil base material according to claim 7, wherein the first-stage hydrotreatment is carried out at a liquid hourly space velocity of 0.05–5 $h^{-1}$ and a hydrogen/oil ratio of 250–1700 $Nm^3/m^3$, and said second-stage hydrotreatment is effected at a liquid hourly space velocity of 0.1 to 10 $h^{-1}$ and a hydrogen/oil ratio of 50–1700 $Nm^3/m^3$.

* * * * *